United States Patent [19]

Shubow

[11] Patent Number: 4,587,782

[45] Date of Patent: May 13, 1986

[54] BEARING WALL AND JOINT CONSTRUCTION

[76] Inventor: Calvin Shubow, 30205 Summit Dr., Farmington Hills, Mich. 48018

[21] Appl. No.: 649,179

[22] Filed: Sep. 10, 1984

[51] Int. Cl.[4] ..... E04B 2/58

[52] U.S. Cl. ..... 52/251; 52/289; 52/300; 52/439

[58] Field of Search ..... 52/289, 251, 272, 789, 52/300, 236.6, 439

[56] References Cited

U.S. PATENT DOCUMENTS 3,391,507 7/1968 Downing ..... 52/289

3,662,507 5/1972 Espeland ..... 52/289

*Primary Examiner*—Billy S. Taylor

*Attorney, Agent, or Firm*—Krass and Young

[57] ABSTRACT

A building construction employing precast concrete slabs and prefabricated steel joists. The concrete slabs include generally parallel core channels extending vertically through the slabs from the lower edge of the slabs to the upper edge of the slabs between the outer and the inner faces of the slabs. The building is formed by placing several of the precast slabs in upright form side by side to form a wall of the building; providing slots in the upper edges of the precast slabs in association with certain of the core channels in the slabs with the slots extending from the upper edges of the slabs downwardly into the slabs and extending laterally from the related core channel to the inner face of the slab; placing a cookie in the core channel at a level below the bottom of the slot; pouring locally mixed concrete into the core channel to provide a poured concrete plug in the core channel extending from the level of the cookie to the bottom of the slot; placing a steel bearing plate in the slot on top of the poured concrete plug; positioning a prefabricated steel joist in the bottom of the slot with the end of the joist positioned in the core channel; and pouring further locally mixed concrete into the core channel on top of the joist to form a further poured concrete plug extending from the top of the joist to the top of the wall slabs and filling the slot. The building construction is then completed by laying suitable roofing material over the joists to form the roof of the building.

12 Claims, 2 Drawing Figures

BEARING WALL AND JOINT CONSTRUCTION

BACKGROUND OF THE INVENTION

This invention relates to building constructions and, more particularly, to a novel bearing wall and joist construction employing precast concrete slabs with hollow core channels.

Pre-cast concrete slabs offer considerable promise in cost savings because of the economies of scale resulting from mass production of the slab at centralized factory facilities. These cost savings, however, are offset, at least in part, by the fact that the various prior art techniques for assembling the slabs at local building sites to form the ultimate building are complicated and labor-intensive and therefore expensive.

SUMMARY OF THE INVENTION

The present invention is directed to a unique building construction employing precast concrete slabs wherein the on-site construction procedure is considerably simplified with a resultant significant reduction in overall building costs.

The invention building construction employs the well known and readily available precast concrete wall slabs of the type including generally parallel core channels extending vertically through the slab from the lower edge of the slab to the upper edge of the slab between the outer and inner faces of the slab. In the building construction of the invention, at least one precast slab is positioned veritcally; a vertical slot is formed in the slab in alignment with one of the core channels and extends vertically from the upper edge of the slab downwardly into the slab and laterally from the core channel to the inner face of the slab; and a joist is positioned in the bottom of the slot with its one end positioned in the core channel. This simple basic construction procedure allows the rapid and inexpensive formation of a one story building construction.

According to a further feature of the invention, a plug of poured concrete fills the core channel from the level corresponding to the bottom of the slot to a level below the bottom of the slot. The plug of poured concrete underlies the end of the joist and firmly supports the joist.

According to a further feature of the invention, a bearing plate is positioned on top of the poured concrete plug and underlies the end of the joist to provide a firm joist footing in the wall slab.

According to yet another feature of the invention, a further plug of poured concrete fills the core channel from the upper face of the joist to the upper face of the slab. This further plug coacts with the plug positioned below the joist to firmly embed the end of the joist in the slab.

According to yet another feature of the invention, a cookie is secured in the core channel at a level above the lower edge of the slab and below the bottom of the slot. The cookie serves to define the lower limit of the lower poured concrete plug and allows a minimal amount of poured concrete to be employed while yet insuring a firm foundation for the end of the joist.

DETAILED DESCRIPTION OF THE PREFERRED EMBODIMENT

Figure 1:
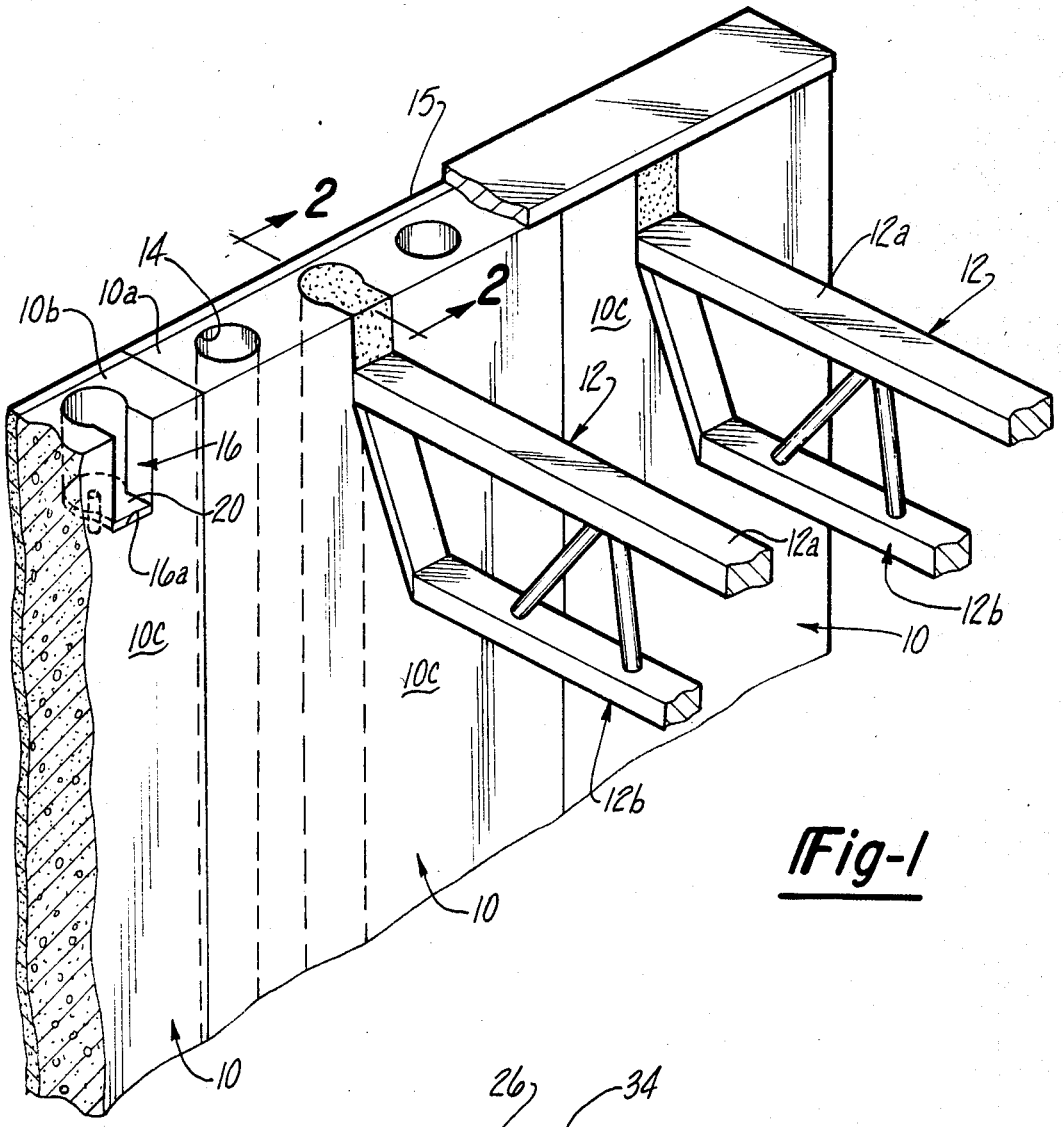
FIG. 1 is a perspective view of a building construction according to the invention.
Figure 2:
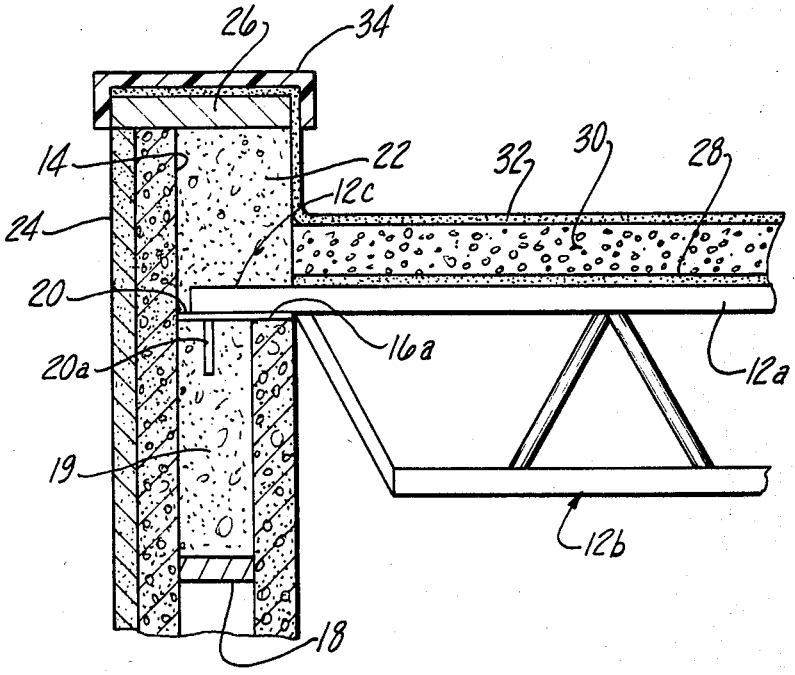
FIG. 2 is a cross-sectional view taken on line 2—2 of FIG. 1.

The invention building construction employs precast concrete slabs 10 and prefabricated steel joists 12.

The concrete slabs 10 are of the type including a plurality of generally parallel core channels 14 extending from the upper edge 10*a* of the slab to the lower edge (not seen) of the slab between the outer slab face 10*b* and the inner slab face 10*c*. An insulation panel 15 may be suitably secured to the outer face 10*b* of each slab.

Steel joists 12 are of known construction and include an upper beam member 12*a* and an underlying truss structure 12*b*.

Pre-cast slabs 10 and prefabricated joists 12 are typically formed at factory facilities and shipped to the local building site. At the building site, a plurality of wall slabs 10 are vertically positioned side by side to form an exterior wall of the building with panels 15 providing exterior insulation for the building. A slot 16 is then suitably cut in at least certain of the slabs in association with at least certain of the core channels. Each slot extends vertically from the upper edge 10*a* of the slab downwardly into the slab and extends laterally from the related core channel to the inner face 10*c* of the slab so that the slot, in effect, removes substantially all of the slab material between the core channel and the inner slab face 10*c*. Slot 16 preferably has a width somewhat less than the diameter of core channel 14 so that the slot and core channel form a keyhold configuration. A cookie 18, formed of styrofoam or a similar material and sized to have a force fit within a core channel 14, is shoved downwardly into the core channel to a position below the bottom 16*a* of slot 16 where it is wedged in position in the core channel. Locally mixed concrete is now poured into the core channel to form a plug 19 of poured concrete filling the core channel from the level of the cookie to a level corresponding to the bottom 16*a* of slot 16. A steel bearing plate 20, sized and configured to fit snugly within the total opening defined by slot 16 and associated core channel 14, is then positioned in the bottom of slot 16 in overlying relation to the wet poured concrete plug 19. A keel pin 20*a* formed integrally with the bearing plate extends downwardly into the wet poured concrete plug 19 to provide stability for the bearing plate relative to the concrete plug. A joist 12 is now positioned in the bottom of the slot 16 in overlying relation to bearing plate 20 and with the end 12*c* of the joist positioned in core channel 14. Locally mixed concrete is now poured into the upper end of core channel 14 to form a further plug 22 of poured concrete filling core channel 14 and slot 16 from the upper face of the joist to the upper face 10*a* of the slab. A suitable form (not shown) may be positioned at slab face 10*c* to maintain the poured concrete in slot 16 until the poured concrete has set. The other ends (not shown) of joist beam 12*a* are of course similarly embedded in another wall formed of side by side slabs 10.

The building construction is now completed by positioning a suitable nailer 26 on and along the aligned top edges of the slabs; positioning metal sheeting 28 over the main beams 12*a* of joists 12; positioning suitable insulative panels 30 over sheeting 28; positioning suitable roofing material 32 over insulative panels 30 with the roofing material extending upwardly along the inner face of the wall slabs and over the top of nailer 26; and positioning a cap 34 over nailer 26.

The invention building construction will be seen to provide a simple and effective way of erecting a building. The invention building construction minimizes the amount of labor and local materials required at the local building site and thereby optimizes the cost savings aspect obtained by the use of the precast concrete slabs and prefabricated joists.

Whereas a preferred embodiment has been illustrated and described in detail, it will be apparent that various changes may be made in the preferred embodiment without departing from the scope or spirit of the invention.

I claim:

1. A building construction comprising:

A. at least one precast concrete wall slab positioned vertically and having at least one core channel extending vertically therethrough from the lower edge thereof to the upper edge thereof between outer and inner faces thereof;

B. a vertical slot, formed in said slab in alignment with said core channel, extending vertically from the upper edge of said slab downwardly into said slab for a distance corresponding to a minor fraction of the total height of the slab and laterally from said core channel to said inner face of said slab; and C. a joist positioned in the bottom of said slot with its one end positioned in said core channel.

2. A building construction according to claim 1 and further comprising:

D. a plug of poured concrete filling said core channel from the level corresponding to the bottom of said slot to a level below the bottom of said slot, whereby to underly and support said one joist end.

3. A building construction according to claim 2 and further comprising:

E. a bearing plate positioned on top of said poured concrete plug and underlying said one joist end.

4. A building construction comprising:

A. at least one precast concrete wall slab positioned vertically and having at least one core channel extending vertically therethrough from the lower edge thereof to the upper edge thereof between outer and inner faces thereof;

B. a vertical slot, formed in said slab in alignment with said core channel, extending vertically from the upper edge of said slab downwardly into said slab and laterally from said core channel to said inner face of said slab;

C. a joist positioned in the bottom of said slot with its one end positioned in said core channel;

D. a plug of poured concrete filling said core channel from the level corresponding to the bottom of said slot to a level below the bottom of said slot, whereby to underlie and support said one joist end;

E. a bearing plate positioned on top of said poured concrete plug and underlying said one joist end; and F. a further plug of poured concrete filling said core channel from the upper face of said one joist end to said upper face of said slab, whereby to firmly embed said one joist end in said slab.

5. A building construction according to claim 4 wherein said further plug also fills said slot above said joist.

6. A building construction according to claim 2 and further comprising:

E. a cookie secured in said core channel at a level above the lower edge of said slab and below the bottom of said slot, whereby to define the lower limit of said poured concrete plug.

7. A method of constructing a building employing precast concrete slabs having generally parallel core channels extending therethrough from the lower edge thereof to the upper edge thereof between outer and inner faces thereof, said method comprising the steps of:

A. erecting a course of said precast concrete slabs with said core channels extending vertically;

B. forming a vertical slot in certain of said slabs in alignment with certain of said core channels with each such slot extending vertically from the upper edge of the related slab downwardly into the slab for a distance corresponding to a minor fraction of the total height of the slab and laterally from the related core channel to the inner face of the slab; and C. positioning a joist in the bottom of each of said slots with the one ends of the joists positioned in the respective core channels.

8. The method of claim 7 and including the further step of:

D. forming a plug of poured concrete in said certain core channels from the level corresponding to the bottom of the related slot to a level below the bottom of that slot, whereby to underly and support said one joist ends.

9. The method of claim 8 and including the further step of:

E. positioning a bearing plate on the top of each said poured concrete plug to respectively underly said one joist ends.

10. A method of constructing a building emloying precast concrete slabs having generally parallel core channels extending therethrough from the lower edge thereof to the upper edge thereof between outer and inner faces thereof, said method comprising the steps of:

A. erecting a course of said precast concrete slabs with said core channels extending vertically;

B. forming a vertical slot in certain of said slabs in alignment with certain of said core channels with each such slot extending vertically from the upper edge of the related slab downwardly into that slab and laterally from the related core channel to the inner face of the slab;

C. forming a plug of poured concrete in said certain core channels from the level corresponding to the bottom of the related slot to a level below the bottom of that slot;

D. positioning a bearing plate on the top of each said poured concrete plug;

E. positioning a joist in the bottom of each of said slots with the one ends of the joists positioned in the respective core channels in overlying relation to the respective bearing plate; and F. forming a further plug of poured concrete in said certain core channels from the upper face of the respective one joist ends to the upper edge of the respective slab, whereby to firmly embed said one joist ends in said slab.

11. The method of claim 10 wherein each said further plug also fills the respective slot above said joist.

12. The method of claim 8 and including the further step of:

E. securing a cookie in said certain core channels at a level above the lower edge of the related slab and below the bottom of the related slot, whereby to define the lower limit of said poured concrete plugs.

* * * * *